United States Patent [19]

Galperin et al.

[11] 4,007,622

[45] Feb. 15, 1977

[54] DEVICE FOR BENDING THIN-WALLED PIPES

[76] Inventors: Abram Isaevich Galperin, 7 Parkovaya ulitsa, 25a, korpus 21, kv. 25; Lev Vladimirovich Vishnyakov, 3 Frunzenskaya ulitsa, 13, kv. 86; Boris Vladimirovich Pokrovsky, Schelkovskoe shosse, 81, kv. 94; Vladimir Ioganovich Kalganov, ulitsa Scherbakovskaya 57/20, kv. 277; Boris Borisovich Vasiliev, Khorovodny proezd, 20, kv. 51; Igor Nikolaevich Kotikov, ulitsa Textilschikov, 2/20, kv.8, all of Moscow, U.S.S.R.

[22] Filed: May 1, 1975

[21] Appl. No.: 573,514

[52] U.S. Cl. ..... 72/393; 72/369

[51] Int. Cl.[2] ..... B21D 9/14

[58] Field of Search ..... 72/369, 370, 392, 393, 72/306, 307

[56] References Cited

UNITED STATES PATENTS

| | | | |
|---|---|---|---|
| 1,825,030 | 9/1931 | Vaughn | 72/393 |
| 3,877,282 | 4/1975 | Pogonowski | 72/393 |

FOREIGN PATENTS OR APPLICATIONS

| | | | |
|---|---|---|---|
| 274,622 | 1970 | U.S.S.R. | 72/370 |

*Primary Examiner*—Lowell A. Larson

[57] ABSTRACT

Device for bending thin-walled pipes from inside by embossing them with eccentric corrugations, comprising an expander block introducible into the pipe to the point of bend, the block being formed by a supporting shoe and a punch whose side facing the pipe has a toroidal surface following the shape of the desired corrugation and which is mounted on the shoe with a provision for positive movement in a radial direction to the pipe surface for making the corrugation on the pipe. In the cross-sectional plane of the pipe the punch has the shape of a ring which is open at the side of the shoe and is composed of individual elements around its parameter, each element being articulated to a movable member of one of the power cylinders whose axes are arranged radially to a cross-sectional plane of the pipe while their stationary members are connected with the supporting shoe. The stroke of the movable elements of the power cylinders is practically equal to the height of the corrugation on the corresponding generatrix of the pipe.

5 Claims, 7 Drawing Figures

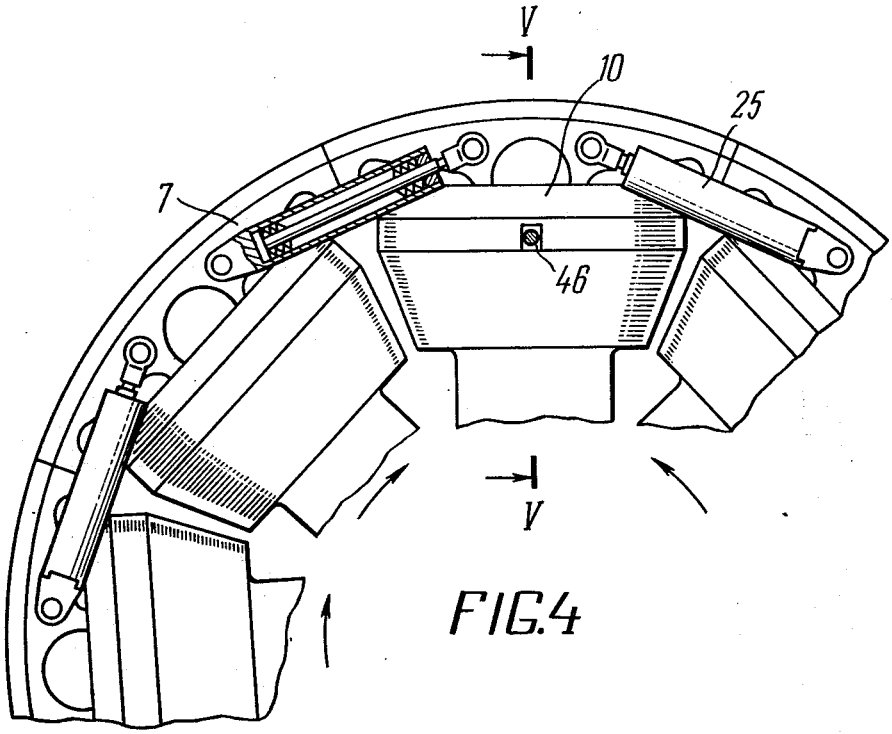
FIG.4
FIG. 5
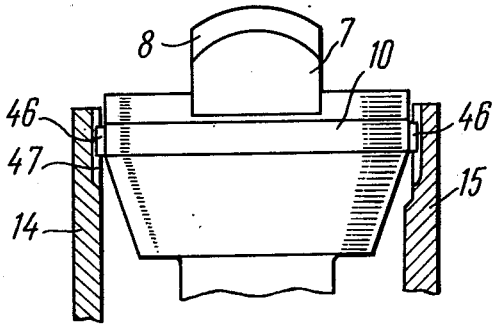

DEVICE FOR BENDING THIN-WALLED PIPES

The present invention relates to the plastic working of metals and more particularly it relates to devices for bending thin-walled pipes in a cold state.

The present invention will be used most successfully for bending large-diameter thin-walled pipes while making elbows for curved sections of trunk pipelines which carry various materials such as gases, petroleum products, water, etc.

At present in laying trunk pipelines for bending the pipes with a diameter of 300 – 1400 mm and a relative thickness of their walls of about 0.01, pipe-bending devices are employed which bend the pipes in a cold state in the field conditions by applying bending forces to the external surface of the pipe. These devices are capable of bending pipes to comparatively large radiuses reaching 25 – 60 pipe diameters.

Due to an ever-growing tendency towards increasing the diameter of the pipe and reducing the relative thickness of its walls, cold bending of pipes becomes seriously complicated since the devices now in existence prove to be so heavy and cumbersome that their transportation and operation become difficult and costly while a decrease in the longitudinal stability of the pipe owing to a smaller thickness of its walls may bring about its failure in the course of bending.

Besides, in the known devices the possibility of bending the pipe without damaging it is determined both by the bending moment and the length of the arms of the bending forces applied to the pipe which calls for arranging the power bending elements at a considerable distance from each other and thus increases the length of the pipe-bending devices, approaching not less than 5 – 8 pipe diameters.

Profound consideration of these problems has proved that an acceptable and efficient method in laying large-diameter trunk pipelines is the method of forced corrugation of pipes.

There are widely employed devices for making corrugations of various profiles and shapes on the pipe; however, in the area of pipe bending the making of corrugations is only an auxiliary operation which precedes the actual bending while the process of proper bending is carried out with the aid of some other pipe-bending devices.

Also known in the art are devices for bending thin-walled pipes wherein the process of corrugating constitutes the actual process of bending.

Such a device comprises an expander block introducible into the pipe to the point of bend, the expander block being formed by a supporting shoe and a punch. The latter has a toroidal surface following the shape of the corrugation at the side facing the pipe and is mounted on the shoe with a provision for being positively moved relative to it in a radial direction to the surface of the pipe for making a corrugation on said pipe.

The supporting shoe in such a device is formed by a tubular mandrel whose diameter is equal to the inside diameter of the pipe while the punch is constituted by a slide installed in guides on the front end of the mandrel.

For pressing out a corrugation on the pipe, the slide is moved over the mandrel guides in a radial direction to the pipe surface by means of a wedge controlled by a rod passing through the mandrel, and it is linked kinematically with a drive located outside the pipe.

The device is also provided with a circular die embracing the pipe on the outside and having an annular toroidal groove in the shape of a corrugation. The pipe is bent by making a series of such corrugations the number of which depends on the required bending angle of the pipe.

However, in view of the requirements for trunk pipelines the known devices of such a type are unsuitable in the field conditions in view of a number of inherent disadvantages.

The main disadvantage of the devices for pipe bending lies in that, due to displacement of the punch in one direction, the pipe acquires semi-circular corrugations which are eccentric relative to the pipe axis; the formation of these corrugations impairs considerably the efficiency of the bending process which is determined by the angle of pipe bending produced by making a single corrugation with a preset height and causes undue internal stresses on the pipe walls after bending.

Another disadvantage of the known devices lies in the necessity of using a circular die embracing the external surface of the pipe for forming corrugations of a correct shape.

The employment of such dies in the field conditions complicates considerably the process of bending long pipes and those lying on the ground or in a trench; besides, it rules out the bending of pipes provided with external insulation which can be damaged by the die.

Among the disadvantages of the known devices there is also the fact that their drive is located outside the pipe at its end, which likewise involves considerable difficulties in bending long pipes under field conditions, particularly when the pipe has to be turned in different planes.

Finally, the known devices have no auxiliary means for free movement and rotation of the expander block inside the pipe with a minimum friction against its walls, which proves extremely inportant while bending large-diameter pipes with a correspondingly heavy weight of the bending device, since it may bring damage to the inside surface of the pipe.

An object of the present invention is to provide a device for bending thin-walled pipes by embossing them with eccentric corrugations, said device allowing the formation of the corrugations practically around the entire pipe perimeter and thus to step up the efficiency of bending of large-diameter pipes.

Another object of the invention is to provide a device for bending thin-walled pipes by convering them with eccentric corrugation which ensures the bending of long pipes, insulated pipes and those lying on the ground and in trenches of trunk pipelines.

Another object of the invention is to provide a device for bending thin-walled pipes which allows changing the plane of pipe bending practically at any point throughout its length.

Still another object of the invention is to provide a more compact device that is convenient in operation.

These and other objects are accomplished in a device for bending thin-walled pipes by embossing them with eccentric corrugations, the device comprising an expander block introducible into the pipe to the point of the desired bend, the expander block being formed by a supporting shoe and a punch whose side facing the pipe has a toroidal surface following the shape of the corrugation and which is installed on the shoe during pipe bending with a provision for positive motion in a radial direction to the pipe surface for forming a corrugation.

According to the invention, the punch in the cross-sectional plane of the pipe has the shape of a ring which is open at the side of the shoe and is composed of individual elements that are articulated to the movable member of one of the power cylinders whose axes lie in a cross-sectional plane of the pipe whereas fixed members are connected with the supporting shoe, the travel of the movable member of each power cylinder being essentially equal to the height of the corrugation on the corresponding generatrix of the pipe.

Such a punch structure and its drive makes it possible to press out an eccentric corrugation on the pipe, the height of the corrugation on one of the pipe generatrices, under the supporting shoe, being equal to zero and reaching a maximum on the diametrically opposite generatrix. This increases considerably the efficiency of pipe bending because the curving angle of the pipe axis during the formation of a circular corrugation is comparatively larger than during the formation of a semi-circular corrugation of the same height; hence, a given bending angle of the pipe will call for making a smaller number of corrugations which, naturally, will improve the efficiency of the pipe-bending device.

Besides, the possibility of bending pipes by embossing them with circular corrugations rules out the danger of internal stresses in the pipe walls whereby the pipe life is extended.

In addition, the possibility of adjusting the travel of the movable member of each power cylinder, depending on the height of the corrugation on the corresponding section of the pipe, permits bending the pipes without the external die; hence, it becomes possible to bend insulated and long-measure pipes as well as those lying in the trenches of the trunk pipelines.

It is recommended that the stationary members of all the power cylinders and the supporting shoe be mounted on a hub which is coaxial with the pipe with the aid of eccentric shafts arranged around the hub, parallel to the pipe axis, the ends of the shafts located at one of the hub ends being linked kinematically with one another and with an independent drive for their joint rotation.

Such a solution makes it possible to press all the elements of the punch together with the corresponding power cylinders and the supporting shoe, against the hub, to allow free introduction of the expander block into the pipe and its turning there; then, before the bending operation all the elements of the punch and the supporting shoe can be moved radially at will until they come in contact with the internal surface of the pipe within the tolerance limits of its nominal diameter.

It is also advisable that the supporting shoe and the stationary member of its opposite power cylinder at both ends of the hub be interconnected by means of two parallel side plates one of which mounts an independent drive of the eccentric shafts while the elements of the punch are consecutively articulated to one another by flexible braces.

Such a structure ensures a radial and symmetrical position of all the power cylinders relative to the plane of the pipe bend and thus ensures the symmetry of the corrugation being formed on the pipe while the flexible braces take up the clearances between the elements of the punch pressed against the pipe surface, which reduces the influence of these clearances during the working stroke of the punch on the quality of the pipe being bent, and diminishes the danger of the pipe walls being pressed into the pipe at the jointing points of the punch elements.

Besides, the provision of two parallel side plates in the expander block permits their employment for mounting the elements of the device drives.

According to one of the optional features of the invention the hub is freely mounted on the shaft passing through the corresponding holes in the side plates and is spline-connected with them while the ends of the shaft rest on self-propelled trolleys, one of which carries a mechanism intended to turn the shaft around its axis together with the expander block relative to these trolleys.

Such an arrangement allows the device to be introduced into the pipe easily, without friction against the pipe walls, which rules out their damage and facilitates auxiliary operations related to moving the expander block inside the pipe for making corrugations and to turning said block in order to change the bending plane.

The turning mechanism may take the form of a worm pair whose wheel is secured on the end of the shaft while the worm is connected by a ratchet with a twining lever.

Now the invention will be described in detail by way of an exemplary embodiment with reference to the accompanying drawings in which:

FIG. 1 is a schematic general side view of the device according to the invention for bending thin-walled pipes by embossing them with eccentric corrugations;

FIG. 2 a kinematic scheme of the drive of expander block eccentric shafts according to the invention in a perspective view;

FIG. 4 is a view along arrow A in FIG. 1:

FIG. 5 is a section taken along line V—V in FIG. 4;

Figure 1:
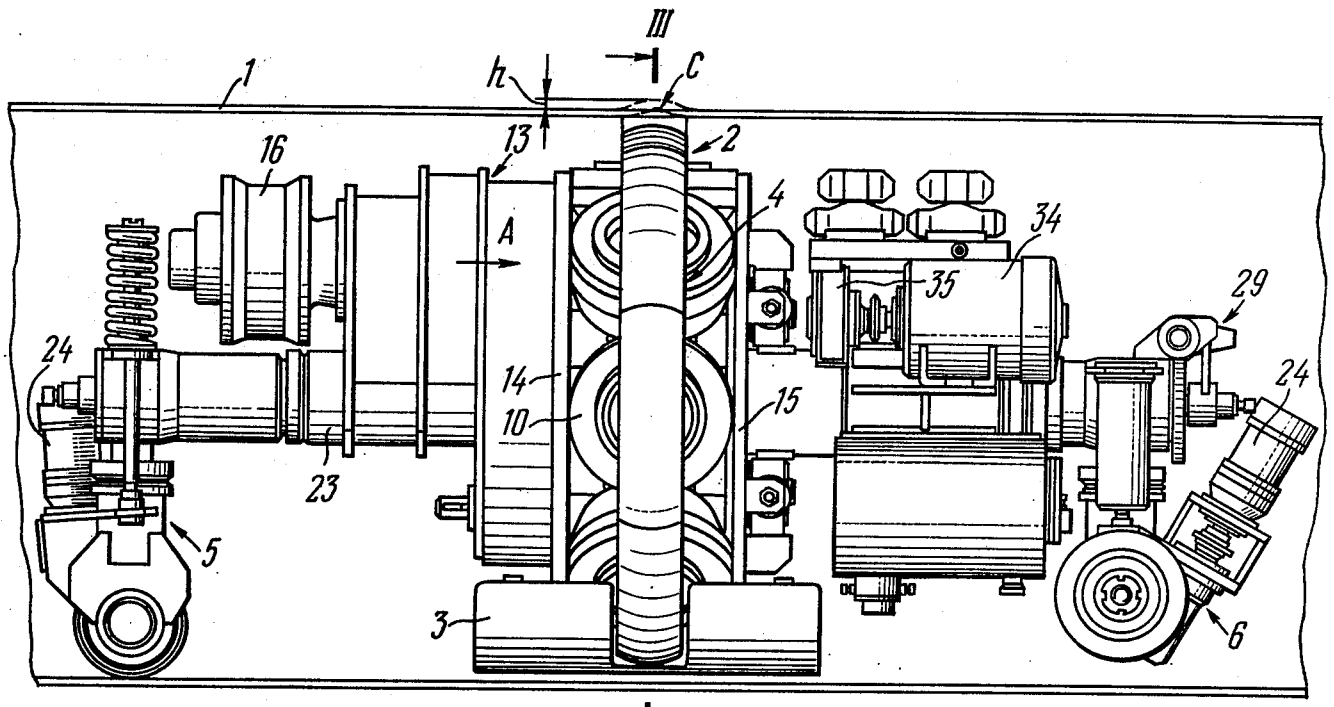

The device for bending thin-walled pipes according to the invention, making eccentric corrugation inside the pipe, is intended for bending large-diameter pipes (300 – 1400 mm) used in laying trunk pipelines.

The device can be introduced into a pipe 1 (FIG. 1) and comprises an expander block 2 formed by a supporting shoe 3 whose side facing the pipe 1 follows the shape of its internal surface, and a punch 4 which is mounted on the supporting shoe 3 with provision for positive movement with respect to the latter in a radial direction to the surface of the pipe 1 for making on it a corrugation C which is eccentric to the pipe axis.

While the corrugation C is bening formed, the length of the pipe generatrices is decreased from zero (under the supporting shoe 3) to a maximum value which is equal to the maximum height $h$ of the corrugation C, this curves the axis of the pipe 1, and it bends towards the maximum height $h$ of the corrugation C.

The expander block 2 is mounted on two self-propelled trolleys 5 and 6 used to introduce the block into the pipe 1 to the point of bend and to move it in the pipe.

Figure 2:
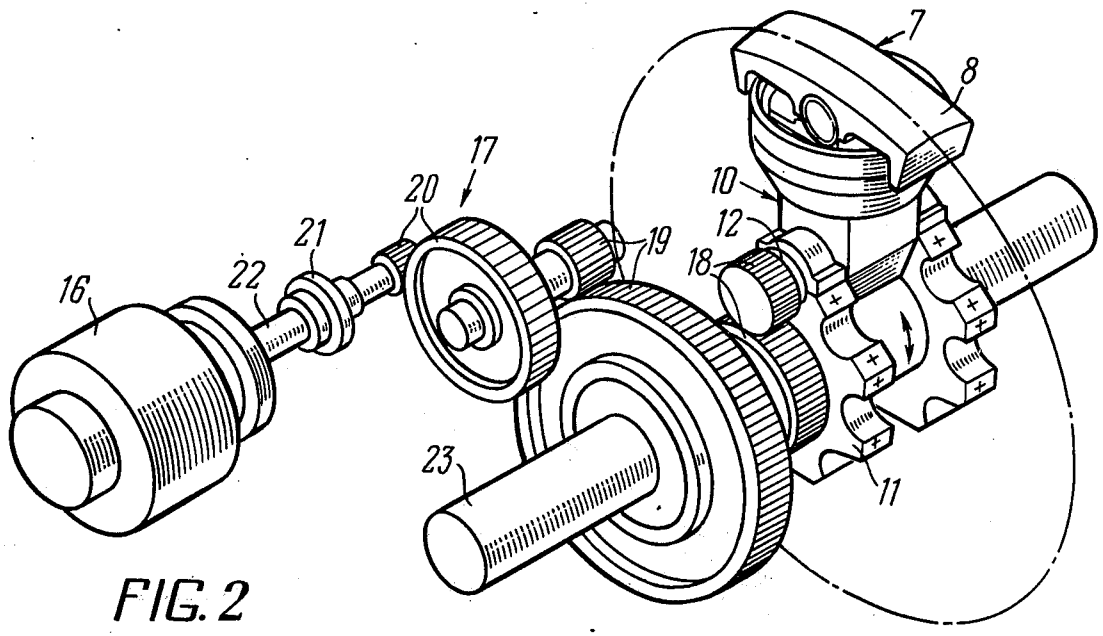
Figure 3:
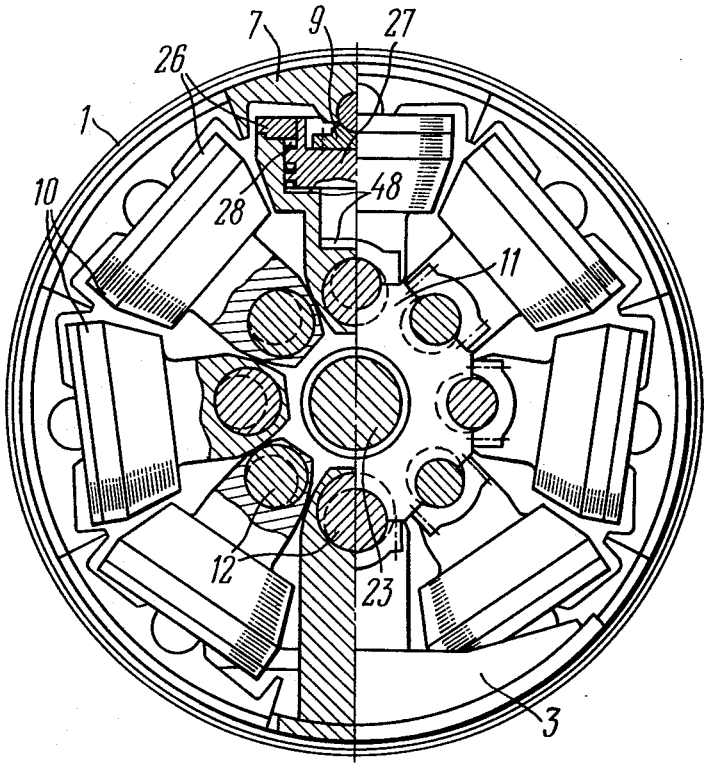
FIG. 3 is a section taken along line III—III in FIG. 1.

The punch 4 according to the invention in the cross-sectional place of the pipe 1 has the form of a ring which is open at the side of the shoe 3 and is composed of individual punch elements 7 (FIGS. 2 and 3) around the parameter of the punch.

On the side facing the pipe 1 each of the elements 7 has a toroidal surface 8 following the shape of the corrugation C while at its opposite side each element is articulated to a movable member, i.e. a rod 9 of a power cylinder. These may be hydraulic cylinders 10 whose axes are set radially in one cross-sectional plane of the pipe 1 while the cylinders proper are connected with the supporting shoe 3 by means of a central hub 11 which is coaxial with the pipe 1.

The stationary members (cylinders proper) of all the hydraulic cylinders 10 and the supporting shoe 3 are mounted on the hub 11, according to the invention, by means of eccentric shafts 12 arranged around the hub parallel to the axis of the pipe 1; at one side of the hub 11 the ends of said shafts 12 are kinematically linked with one another and with an independent hydraulic drive 13 for their joint turning.

As a result, the elements 7 of the punch 4 and the supporting shoe 3 can be adjusted radially for pressing them against the inside surface of the pipe 1 before bending, and for withdrawing the elements 7 of the punch 4 and the shoe 3 from the surface of the pipe 1 before moving the device along the pipe axis.

The supporting shoe 3 and the cylinder proper of the opposite hydraulic cylinder 10 are interconnected at both ends of the hub 11 by two parallel side plates 14 and 15 (FIG. 1) one of which (14) mounts the drive 13 of the eccentric shafts 12, the drive consisting of a hydraulic motor 16 (FIG. 2) a three-stage reduction gear 17 consisting of three pairs of spur gears 18, 19 and 20, and a clutch 21 which couples the reduction gear with an output shaft 22 of the hydraulic motor 16.

According to the invention the hub 11 is freely mounted on a central shaft 23 whose ends are installed on the self-propelled trolleys 5 (FIG. 1) and 6, each trolley being provided with an independent hydraulic motor 24 for moving the device through the pipe 1.

In this case the shaft 23 passes through holes in the side plates 14 and 15 (FIG. 2), being spline-connected with the latter (the splined joint is not shown in the drawing).

According to the invention, the elements 7 of the punch 4 are articulated successively with one another by resilient braces in the form of plate springs 25 (FIG. 4) and are thus directed towards the middle hydraulic cylinder 10 (the one connected with the supporting shoe 3 by side plates 14 and 15) to form a continuous circular corrugation C.

The eccentric corrugation C is made on the pipe 1 because the stroke of the rods 9 of the hydraulic cylinders 10 is, according to the invention, practically equal to the height $h$ of the corrugation C on the corresponding generatrices of the pipe 1, for which purpose there are gaskets 28 of a corresponding thickness installed between the covers 26 (FIG. 3) of the hydraulic cylinders 10 and their pistons 27, for limiting the stroke of the rods 9 of the hydraulic cylinders 10.

Figure 6:
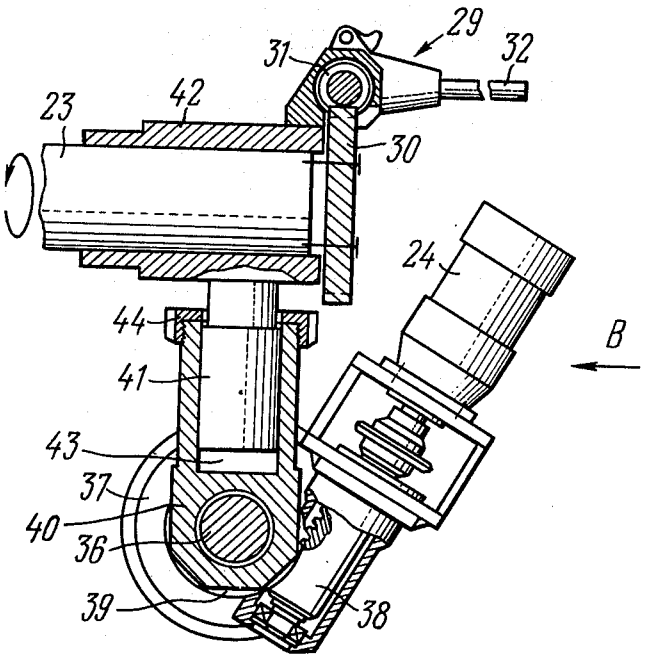
FIG. 6 is a general view of a self-propelled trolley for moving the device inside a pipe, with a partly longitudinal cutaway.

The self-propelled front trolley 6 carries a mechanism 29 (FIG. 6) to turn the central shaft 23 around its axis together with the expander block 2 relative to both trolleys 5 and 6, for bringing the expander block 2 to a position which determines the required bending plane of the pipe 1.

The mechanism 29 for turning the shaft 23 consists of a worm pair whose wheel 30 is secured on the end of the shaft 23 while the shaft of a worm 31 is provided with a freely-mounted hand operated turning lever 32 connected with the shaft of the worm 31 by means of a ratchet 33 and a pawl.

The other side plate 15 (FIG. 1) of the expander block 2 carries an electric motor 34 for driving an oil pump 35 which powers the hydraulic cylinders 10, the hydraulic drive 16 of the eccentric shafts 12 of the expander block 2, and the independent hydraulic motors 24 of the trolleys 5 and 6.

The device is remotely controlled from a control desk (not shown in the drawing) mounted outside the pipe 1.

An axle 36 of two wheels 37 of each self-propelled trolley 5 and 6 is driven from the hydraulic motor 24 via a worm 38 and a worm wheel 39. The axle 36 of each trolley passes freely through a hole in the lower thicker part of a casing 40 of a lifting hydraulic cylinder whose plunger 41 carries a bushing 42 freely-mounted on the corresponding end of the central shaft 23. The trolleys 5 and 6 are lowered by the pressure fed into a space 43 of the casing 40 of the lifting hydraulic cylinder. The travel of the plunger 41 is adjusted by a hydraulic cylinder cover 44.

Figure 7:
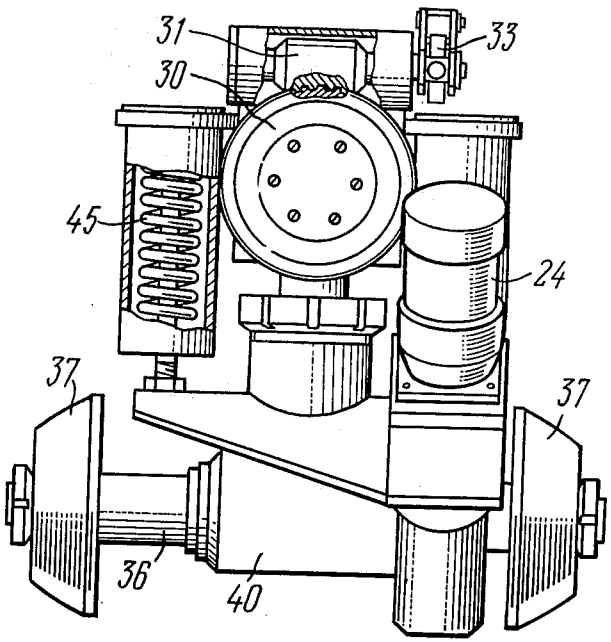
FIG. 7 is a view along arrow B in FIG. 7.

The casings 40 of the hydraulic cylinders of both trolleys 5 and 6 are pulled to the bushings 42 of the central shaft 23 by means of springs 45 (FIG. 7).

The middle hydraulic cylinder 10 of the expander block 2 is fixed against cocking by projections 46 (FIG. 5) entering slots 47 in the side plates 14 and 15 of the expander block 2.

The device for bending thin-walled pipes operates as follows.

Before work, the device is placed on a trough (not shown in the drawing) fastened at the end of the pipe 1. Then the electric motor 34 (FIG. 1) of the oil pump 35 is started and the oil is delivered under pressure into the spaces 43 of the casings 40 of the lifting hydraulic cylinders of both self-propelled trolleys 5 and 6 to lift the device on the wheels 37 and to align the expander block 2 with the axis of the pipe 1 (as shown in FIG. 1).

To ensure a maximum clearance between the inner wall of the pipe 1 and the contacting surfaces of the device, the elements 7 of the punch 4 and the supporting shoe 3 are pulled to the hub 11 before inserting the device into the pipe 1, by feeding the oil under pressure into the reverse-stroke spaces of the hydraulic cylinders 10 of the expander block 2 and by rotating the eccentric shafts 12 by means of the hydraulic motor 16 via the reduction gear 17.

In this case rotation will be transmitted from the shaft 22 (FIG. 2) of the hydraulic motor 16 via the clutch 21 and the gear pairs 20 and 19 of the reduction gear 17 to its central gear 18 that is freely mounted on the shaft 23 and thence to the smaller gears 18 secured on the ends of the eccentric shafts 12 at one side; on turning of these shafts the hydraulic cylinders 10 are moved radially together with the elements 7 of the punch 4 and the supporting shoe 3, towards the hub 11 and are kept in this position. Now the expander block 2 is set on the required bending plane of the pipe 1. This is done by an operator manipulating the turning lever 32 (FIG. 6) which starts rotating the shaft of the worm 31 and the worm wheel 30 so that the central shaft 23 and the expander block 2 turn jointly with the wheel relative to the self-propelled trolleys 5 and 6.

In this case the ratchet 33 allows the central shaft 23 to be rotated intermittently by the swinging motions of the lever 32, and the sense of rotation of the shaft 23 can be changed by switching over the pawl.

All the above preliminary operations bring the device to the initial position, ready to be introduced into the pipe 1, for starting the bending operation.

Then the independent hydraulic motors 24 are started and they begin rotating the axles 36 of the wheels 37 of the trolleys 5 and 6 via the worm 38 and worm wheel 39 so that the device rolls off the trough and moves through the pipe 1 to the point of bend. The position of the device in the pipe 1 can be determined by check marks on the remote-control cable (not shown in the drawing).

As the device reaches the point of bend in the pipe 1, it is stopped and the hydraulic motor 16 (FIG. 2) sets in operation the eccentric shafts 12 (the following operations proceed similarly to those described above but in the reverse sequence) for taking up the clearances between the expander block 2 and the pipe 1, and thus ensuring tight contact between all the elements 7 of the punch 4 and the supporting shoe 3, on the one hand, and the inside surface of the pipe, on the other.

Then the expander block 2 forms a power system closed on the central hub 11. The hydraulic cylinders 40 of the self-propelled trolleys 5 and 6 are turned off, the trolleys are withdrawn by the springs 45 from the pipe 1, being pressed against the central shaft 23, and thus offering no resistance to the subsequent bending of the pipe 1.

Now the oil is fed under pressure into the working-stroke spaces 48 (FIG. 3) of the rods 9 of the hydraulic cylinders 10 of the expander block 2, and the rods 9 move the elements 7 of the punch 4 radially to the surface of the pipe 1, thus pressing out a circular corrugation C (FIG. 1) on the pipe, the corrugation being eccentric to the pipe axis and curving the axis in the direction of the maximum height *h* of this corrugation C.

After forming the corrugation C on the pipe 1, the hydraulic cylinders 10 are reversed and the hydraulic drive 13 of the eccentric shafts 12 is turned on, thereby pressing the elements 7 of the punch 4 and the supporting shoe 3 against the hub 11 (the process takes place in the reverse sequence to that described above).

As the trolleys 5 and 6 are lowered, the device is lifted on the wheels 37 and moves to the next point of bend in the pipe 1 where the entire process of pressing out the corrugation C is repeated. The number of such corrugations C depends on the required bending angle of the pipe 1.

What is claimed is:

1. A device for bending thin-walled pipes by embossing them with eccentric corrugations (C), comprising: an expander block (2) introducible into a pipe (1) to be bent, to the point of the desired bend, and being formed by a supporting shoe (3) and a punch (4), the latter being installed on the former, with provision for positive motion relative to said block in the course of the bending radially to the pipe surface, for making the desired corrugation on the pipe, the corrugation being eccentric to the pipe axis, and for thus bending the pipe; said punch having the shape of a ring in a cross-sectional plane of the pipe, being open at the side of said shoe and composed of individual punch elements (7) around the circumference of said punch; power cylinders (10) whose axis are arranged radially to a cross-sectional plane of the pipe, having movable members (9) that are respectively articulated to said punch elements while having stationary members (10) connected with said shoe; said movable members making strokes that are substantially equal to the height (h) of the desired corrugation on the corresponding generatrix of the pipe.

2. The device as defined in claim 1, wherein said stationary members (10) and said shoe (3) are mounted on a hub (11) coaxial with the pipe (1), with the aid of eccentric shafts (12) arranged around said hub parallel to the pipe axis, the ends of said shafts at one side of said hub being kinematically linked with one another and with an independent drive (13) for their joint turning, which ensures a radial setting of said punch elements 7 and said shoe.

3. The device as defined in claim 2, wherein said shoe (3) and said stationary members (10) of a power cylinder (10) diametrically to said shoe are interconnected at both ends of said hub (11) by two parallel side plates (14, 15), one (14) of which mounts an independent drive (16) of said eccentric shafts (12), while said punch elements are consecutively articulated with one another by resilient braces (25).

4. The device as defined in claim 3, wherein said hub (11) is freely mounted on a hub shaft (23) passing through holes in said side plates (14, 15), and is connected with the latter by a spline, while said ends of the eccentric shafts (12) are installed on self-propelled trolleys (5, 6), one (6) of which carries a mechanism (29) for turning said hub shaft around its axis together with said block (2) relative to said trolleys.

5. The device as defined in claim 4, wherein said turning mechanism (29) is constituted by a worm pair whose worm wheel (30) is fastened on one end of said hub shaft (23) and whose worm (31) is connected by a ratchet (33) with a turning lever (32).

* * * * *